United States Patent [19]

Hager

[11] 4,404,687

[45] Sep. 20, 1983

[54] CONVERTIBLE OUTERWEAR AND CARRYING BAG

[76] Inventor: Markus Hager, 701 Avenue K, Brooklyn, N.Y. 11230

[21] Appl. No.: 438,963

[22] Filed: Sep. 24, 1982

[51] Int. Cl.[3] ..... A41D 23/00; A41D 3/02

[52] U.S. Cl. ..... 2/94

[58] Field of Search ..... 2/93, 94, 84, 85, 86, 2/87, 89

[56] References Cited

U.S. PATENT DOCUMENTS

| | | | |
|---|---|---|---|
| 1,197,236 | 9/1916 | Schnur | 2/87 |
| 1,702,143 | 2/1929 | Weisz . | |
| 2,058,474 | 10/1936 | Long | 2/85 |
| 2,072,030 | 2/1937 | Damron | 2/87 |
| 2,142,814 | 1/1938 | Fitch | 2/93 |
| 2,143,931 | 1/1939 | Aronson | 2/93 |
| 2,146,243 | 2/1939 | Aug | 2/85 |
| 2,248,455 | 7/1941 | Freund | 2/94 |
| 2,292,347 | 8/1942 | Bailey | 2/93 |
| 2,324,722 | 7/1943 | Papierniak | 2/93 |
| 2,325,494 | 7/1943 | Fayer | 2/93 |
| 2,825,902 | 3/1958 | Breier | 2/93 |
| 2,971,198 | 2/1961 | Tomich | 2/84 |
| 3,085,254 | 4/1963 | Cutler | 2/243 |
| 4,055,853 | 11/1977 | Argento et al. | 2/93 |
| 4,225,978 | 10/1980 | Howerton | 2/88 |
| 4,315,334 | 2/1982 | Pearsall | 2/85 |

FOREIGN PATENT DOCUMENTS

| | | |
|---|---|---|
| 239296 | of 0000 | Fed. Rep. of Germany . |
| 2208503 | of 0000 | Fed. Rep. of Germany . |
| 309731 | of 0000 | United Kingdom . |

*Primary Examiner*—Doris L. Troutman

*Attorney, Agent, or Firm*—Gottlieb, Rackman & Reisman

[57] ABSTRACT

There is disclosed a convertible outerwear garment which includes a topologically continuous carrying bag and pouch. The carrying bag comprises a pocket secured to an interior surface of the outerwear at a longitudinally extending garment opening overlying a corresponding opening in the pocket. A carrying bag is provided by inverting the pocket through the garment opening, the carrying bag receiving the topologically continuous outer garment. To this end, the carrying bag is provided with a volume capacity substantially larger than that required for receiving the outerwear and an opening extending substantially across the width of the outer garment. A pouch is provided by a pouch pocket secured in topologically continuous relation to the carrying bag pocket. When neither outerwear nor a carrying bag is required, the garment and carrying bag pocket are stored compactly in the pouch.

16 Claims, 6 Drawing Figures

FIG. 4
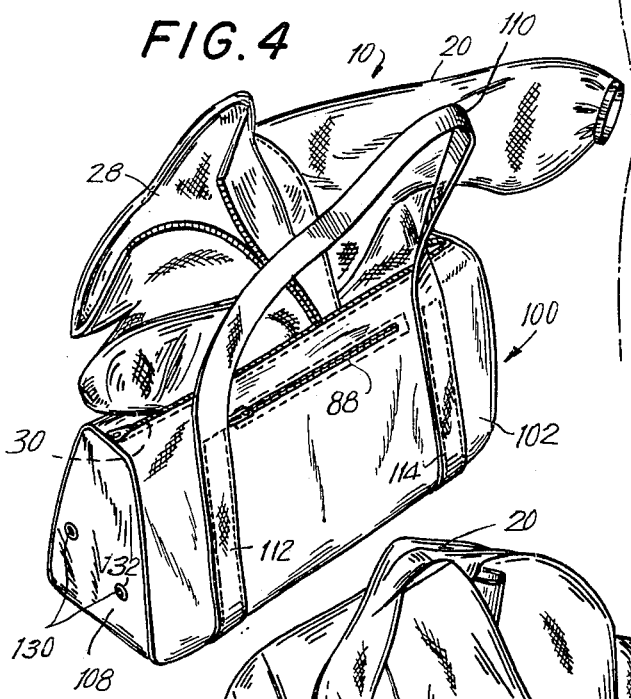
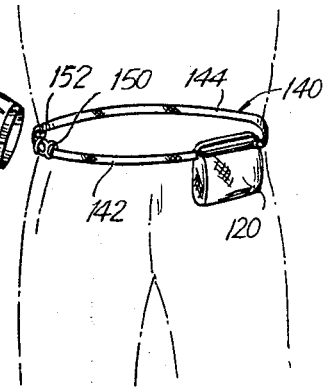
FIG. 6
FIG. 5
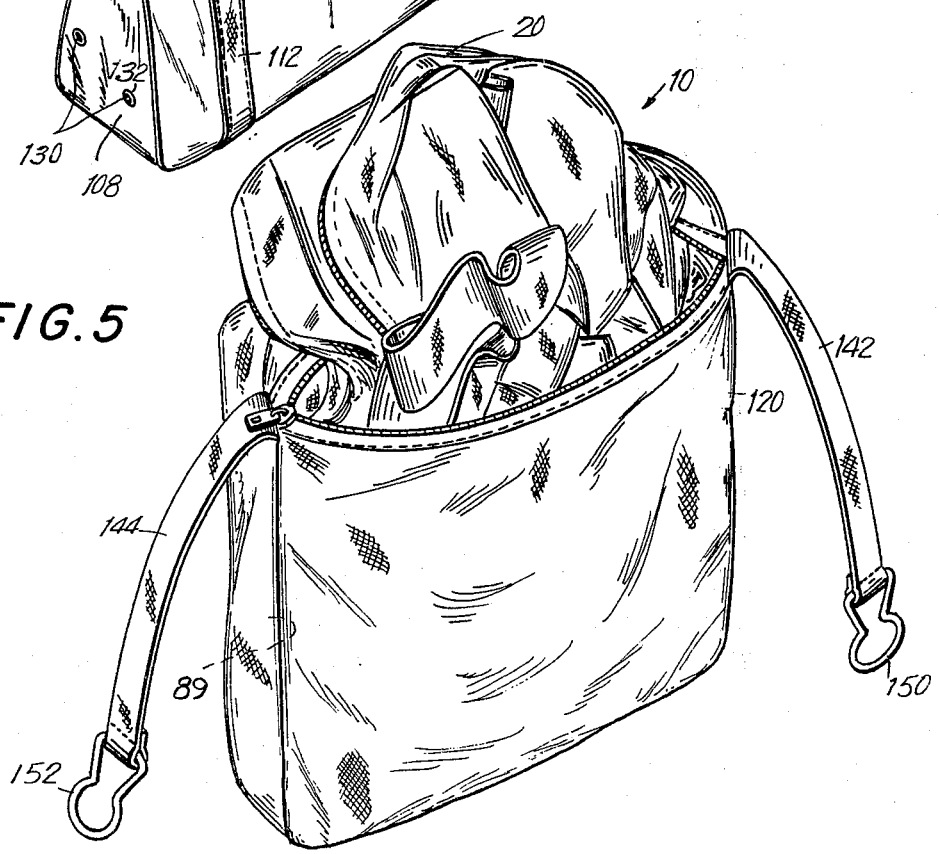

CONVERTIBLE OUTERWEAR AND CARRYING BAG

DESCRIPTION

TECHNICAL FIELD

This invention relates to outerwear of the type which is convertible into carrier bags and pouches and, more particularly, to outerwear provided with an arrangement of topologically continuous pockets wherein the outerwear garment may be readily converted into a carrying bag or pouch.

BACKGROUND ART

Garments which may be converted into carrier bags or similar luggage carriers are generally well-known in the prior art. It is also known in the art to provide a garment wherein a pouch is provided for receiving the garment in a folded arrangement for convenient carriage and storage. Convertible garments which provide carrying bags have general application for use as tote or utility bags. In leisure outerwear and in particular sportswear, garments which may be converted into carrying bags provide convenient barriers for athletic apparel and sporting equipment. In a similar manner, garment and pouch arrangements provide outerwear to accommodate changing weather inclemencies in a readily portable pouch. For these and other reasons, convertible garments have been provided in the form of outerwear and active sportswear apparel.

However, prior art garment and carrying bag arrangements have proved generally unsatisfactory and unworkable in practice in that they have been characterized by elaborate arrangements of securing fasteners and complicated folding procedures. Further limitations in known garment/carrying bag arrangements have been presented by the failure of the art to provide a convertible bag construction having utility for providing both a carrying bag and a large capacity pocket in an aesthetically fashionable manner. In this regard, it will be appreciated that it is advantageous to provide such large capacity pockets so that either the outer garment or pocket may conveniently be used as an enclosure for articles, thus providing convenience and versatility in the convertible garment.

The prior art has also failed to provide a convertible garment arrangement including both carrying bag and pouch constructions. Such an arrangement is needed in the art to provide the convenience of a compact portable pouch for containing a combination outerwear and carrying bag construction.

As representative of the prior art garment and carrying bag arrangements, reference may be had to U.S. Pat. No. 2,146,243 to Aur. This patent discloses a combination garment and handbag wherein the interior of the garment is provided with cooperating "slide fastener" element bearing tapes arranged in spaced horizontal and vertical orientation. A carrying bag is provided by folding the garment into a substantially rectangular arrangement so that the cooperating fastening elements may be engaged at opposing side edges of the rectangle and across a longitudinal end of the folded garment to provide the carrying bag. As a further feature, the patent discloses that it is advantageous to provide an interior yoke or liner overlying the fastening element tapes to alleviate discomfort associated with the arrangement of fastening tapes positioned on the interior surface of the garment. Difficulties with this arrangement are presented in that the outer garment must be folded in a precise manner for engagement of the fastening elements to provide the carrying bag. As a further disadvantage, Aur requires provision of a liner in order to provide an outer garment having a comfort fit, limiting, in large part, application of the Aur design for use in lightweight apparel.

In U.S. Pat. No. 2,058,474 to Long there is disclosed a combination garment and carrying bag which includes a conventional outerwear garment and an interior lining or "body area" having generally opposed arcuate side edges. A carrying bag is provided by folding the outerwear garment within the area defined by the lining body area and securing the arcuate side edges in engagement. For this purpose, Long provides cooperating zipper fastening elements secured to the arcuate lining edges. Once again, this arrangement presents difficulties by the inclusion of fastening elements on an interior surface of the garment, presenting discomfort to the wearer. Also, by reason of complicated folding procedures, Long does not provide a readily convertible garment and carrying bag combination.

Insofar as applicant is aware, other teachings of the art are primarily directed to the provision of garment and pouch arrangements which do not provide the utility and advantages of outerwear of the type to which the present invention is directed wherein there is provided a carrying bag and pouch. Such pouch arrangements of the prior art are represented by U.S. Pat. Nos. 2,292,347, 2,325,494, 2,324,722 and 2,825,902.

Accordingly, it is a broad object of the present invention to provide an improved combination outer garment and carrying bag arrangement.

A more specific object of the present invention is to provide an outerwear garment and carrying bag arrangement wherein the carrying bag is provided by a topologically continuous pocket secured to the garment in an aesthetically fashionable manner.

Another object of the present invention is to provide an outerwear and carrying bag combination including an improved securing bag enclosure design which does not require an overlying protective liner when the combination is arranged to provide an outer garment.

A still further object of the present invention is to provide an outerwear garment and carrying bag combination including a topologically continuous pouch designed to readily receive the combination for convenient portability and storage.

Yet a further object of the present invention is to provide a convertible outerwear carrying bag and pouch combination with improved manufacturing advantages by having fewer, and lesser need for precise tolerances than garments made according to the prior art.

DISCLOSURE OF THE INVENTION

In the present invention, these purposes, as well as others which will be apparent, are achieved generally by providing a convertible garment in the form of a conventional outerwear garment, and a topologically continuous carrying bag pocket secured to the garment at a garment opening in the outerwear, the garment opening being defined by longitudinal panel edge sections of the pocket. A carrying bag is provided by inverting the carrying bag pocket through the garment opening in the outerwear, the outerwear garment being received within the carrying bag. For this purpose, the pocket is dimensioned to provide a carrying bag which encloses an interior space having a volume capacity substantially larger than that required for receiving the outer garment. A securing means for closure of the pocket and the topologically continuous bag includes a coil zipper attached to the longitudinally extending pocket edges. As a further feature of the carrying bag, a handle means including flexible strap members is attached to interior surfaces of the pocket, the handle means being disposed on the exterior surface of the carrying bag formed by inverting the topologically continuous pocket through the garment opening.

In a preferred embodiment of the invention, the convertible garment includes a pouch pocket disposed in topologically continuous relation with the carrying bag pocket. The collapsible garment is arranged in the form of a pouch by inverting the pouch pocket through an access opening in the carrying bag pocket and the garment opening, the pouch receiving the outer garment and carrying bag pocket. The pouch encloses a chamber dimensioned to receive the outer garment and carrying bag pocket in confined arrangement for convenience in carriage and storage. In this embodiment of the invention, the carrying bag pocket includes panels having longitudinal edge sections extending substantially across the width of the outer garment to provide a garment opening of wide cross-section and longitudinal length to permit ready and unencumbered arrangement of the convertible garment in the form of outerwear, carrying bag or pouch.

Other objects, features and advantages of the present invention will be apparent when the detailed description of the preferred embodiment of the invention is considered in conjunction with the drawings which should be construed in an illustrative and not limiting sense, as follows:

BRIEF DESCRIPTION OF THE DRAWINGS

FIG. 4 illustrates the manner in which the outerwear garment is withdrawn from within the topologically continuous carrying bag to provide an outer garment;

FIG. 5 illustrates the manner in which the outerwear garment including integral carrying bag pocket is withdrawn from within the topologically continuous pouch to provide an outer garment; and FIG. 6 is a perspective view of a pouch including an adjustable belt secured to a user with the topologically continuous outerwear collapsed therein.

BEST MODE FOR CARRYING OUT THE INVENTION

Figure 1:
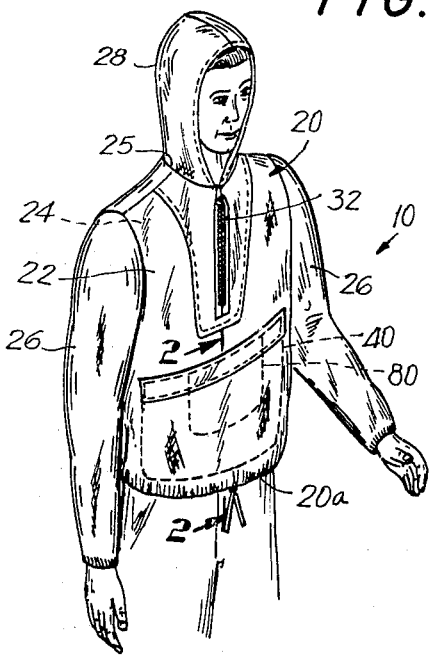
FIG. 1 is a perspective view of the convertible garment of the invention shown in use as a conventionally styled outer garment with topologically continuous carrying bag and pouch pockets illustrated in dashed lines.

Referring now to the drawings and, more particularly to FIGS. 1, 2, 4 and 5, a convertible garment according to the present invention is generally designated 10. Although the convertible garment 10 can be provided in the form of any type of conventional outerwear, convertible garment 10 is advantageously an athletic or leisure wear garment.

The convertible garment 10 comprises a conventionally styled outerwear garment 20 and topologically continuous bag and pouch pockets 40, 80. The outerwear 20 and continuous pockets 40, 80 are secured to the outerwear 20 in topologically continuous relation to provide a convertible garment 10 in the form of outerwear 20, a carrying bag 100 and pouch 120.

The outerwear 20, illustrated in FIG. 1, is of a conventional pullover jacket design having continuous front and rear body portions 22, 24 defining a central head receiving opening 25, arm sleeves 26 and a hood 28. The front body portion 22 of the outerwear 20 includes a longitudinally extending garment opening 30 positioned centrally in spaced relation from a lower edge of the outerwear 20*a*. In order to permit the outerwear 20 to be readily received over a wearer's head, the frontal body portion 22 is also provided with a central transverse opening 32 adjacent the head receiving opening 25. A conventional coil zipper 34, preferably fabricated of nylon is provided for closure of the central transverse opening 32.

Figure 2:
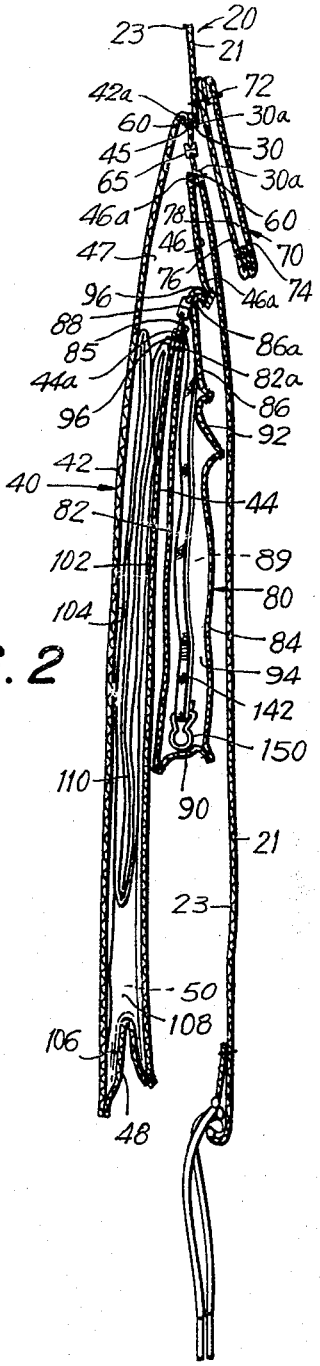
FIG. 2 is a cross sectional view of the convertible garment taken substantially along the line 2—2 of FIG. 1.

The pocket 40, best illustrated in FIG. 2, is secured to an interior surface 23 of the outerwear 20 at the garment opening 30. The pocket 40 includes longitudinally extending panels 42, 44 and 46, base panel 48 and side panels 50 which define an interior pocket chamber 47. A longitudinally extending pocket opening 45 is defined by longitudinal edge sections 42*a*, 46*a* of pocket panels 42, 46, respectively. The pocket opening 45 and garment opening 30 are arranged in aligned relation to provide access to pocket chamber 47 from the exterior surface 21 of the outerwear. For this purpose, stitching 60 is secured peripherally through longitudinally extending pocket edge sections 42*a*, 46*a* and corresponding edge sections 30*a* of the garment opening.

A coil zipper 65, preferably fabricated of nylon, may be provided for closure of the garment opening 30 and corresponding pocket opening 45. Coil zipper 65 shown in FIG. 2, is advantageously secured between longitudinally extending panel edge sections 42*a*, 46*a* and corresponding edge sections 30*a* of the garment opening by the stitching 60. With this arrangement, the rear longitudinally extending pocket panel 42 overlies the zipper 65 to provide a zipper lining and a comfort inner garment fit. On the exterior surface 21 of outerwear 20, there may also be provided a longitudinally extending pocket flap 70 to overlie the coil zipper 65. The pocket flap 70 serves to prevent articles from being dislodged from within the pocket 40 and also provides a stylish outerwear garment 20. The pocket flap 70 may be secured to the exterior outerwear surface 21 by a line of stitching 72, as shown in FIG. 2. Pocket flap 70 includes two layers of nylon or fabric material, 74, 76 which are separated by a layer of fusing or interlining 78 which may be a non-woven polyester.

With particular reference to FIGS. 2 and 4, it will be seen that the collapsible garment 10 is readily arranged in the form of a carrying bag 100 by inversion of pocket 40 through garment opening 30 to provide an enclosure for receiving the outerwear 20 and pouch pocket 80. To this end, the carrying bag pocket 40 is dimensioned to provide a carrying bag 100 enclosing a space substantially larger than required for receiving the outer garment 20. As may be seen with reference to FIGS. 1–3, the garment opening 30 and corresponding pocket opening 45 extend substantially across the width of the outerwear 20. This permits a user of the convertible garment 10 to collapse outerwear 20 within the carrying bag 100 in a uniform motion without requirement of the complicated and time consuming folding procedures of prior art arrangements (see FIG. 4). In a similar manner, the outerwear 20 may be readily removed from the carrying bag 100 to arrange the convertible garment 10 for use as an outer garment.

Figure 3:
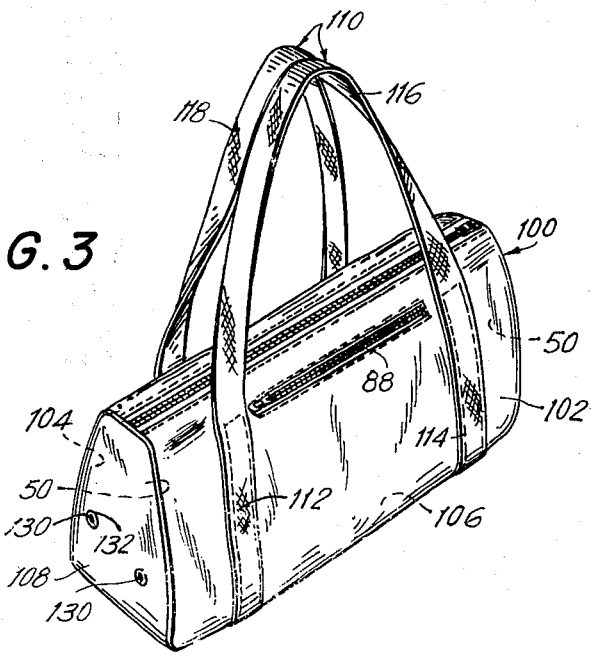
FIG. 3 is a perspective view of the outer garment shown collapsed within a topologically continuous bag which includes exteriorally disposed carrying handles.

Flexible carrying straps 110, preferably fabricated of a light weight cotton material, are sewn or otherwise secured to exterior longitudinal panels 102, 104 and base panel 106 of carrying bag 100, as shown in FIGS. 3 and 4. The carrying straps 110 include spaced strap sections 112, 114 extending around the periphery of the carrying bag 100 and integral exteriorally extending strap sections 116, 118 which connect strap section 112, 114 of carrying bag panels 102, 104, respectively. Those skilled in the art will appreciate that manufacturing advantages may be realized by constructing carrying straps 110 out of a continuous flexible cloth band which may be folded in half to receive the carrying bag 100 and secured by stitching to the outer periphery of the carrying bag 100 to define the arrangement of FIGS. 3–4.

With reference to FIG. 2, it will be seen that the carrying straps 110, by reason of their flexible design may be readily received within the pocket 40 when the collapsible garment 10 is arranged in the form of an outerwear garment 20. In this arrangement of the collapsible garment 10 the exteriorally extending strap sections 116, 118 depend from the interior surfaces of pocket pouch 44, 46 (corresponding to exterior carrying bag panels 102, 104). Advantageously, the flexible design of the carrying straps 110 permits unobstructed access and usage of the carrying bag pocket 40 of the outerwear garment 20.

To provide air circulation within the carrying bag 100 spaced air vent openings 130 may be positioned in the exterior side panels 108 of the carrying bag 100 (see FIG. 3). The air vent openings 130 are preferably reinforced with metal eyelets 132 for durability and aesthetic effect. In this connection, it will be appreciated that air ventilation within carrying bag 100 is particularly desirable where the carrying bag 100 is used to carry leisure wear and athletic apparel.

As a further feature of the invention there is provided a pouch pocket 80 secured in topologically continuous relation to the outerwear 20 and carrying bag pocket 40. The pouch pocket 80 includes longitudinally extending panel sections 82, 84 and 86, side panels 89, base panel 90 and top panel 92 which define an interior chamber 94. Longitudinal panel sections 82, 86 terminate in longitudinally extending edge sections **82*a*, 86*a* which define a pouch pocket access opening 85 in the carrying bag pocket 40 (see FIG. 2). Longitudinally extending edge sections 82*a*, 86*a* of pocket panels 82, 86 are secured to corresponding edge sections 44*a*, 46*a* of carrying bag pocket panels 44, 46 by peripherally extending lines of stitching 96. When the collapsible garment is arranged in the form of outerwear 20, access to interior chamber 94 of pouch pocket 80 is provided through garment and pouch access openings 30, 85. In the carrying bag 100 arrangement of collapsible garment 10, access to the pouch pocket 80 is correspondingly provided in exterior carrying bag panel 102 (see FIGS. 3–4**).

The outerwear 20 is converted into a pouch 120 by inversion of the pouch pocket 80 through the pocket access and garment openings 85, 30 and arrangement of outerwear 20 and carrying bag pocket 40 within the pouch 120 for convenient carriage and storage. In a similar manner, carrying bag 100 may be converted into the pouch 120 by inversion of pocket 80 through pocket access opening 85 for receiving the carrying bag 100 and interiorally disposed outerwear 20. The pouch 120 is provided with a volume capacity dimensioned for receiving the outerwear 20 and carrying bag pocket 40/carrying bag 100 in a confined compact arrangement. For further convenience in carriage, the pouch 120 may be provided with a flexible belt 140, preferably fabricated of an elastic material, for securing the pouch 120 around the waste of a user as shown in FIG. 6. The elastic belt 140 includes portions 142, 144 which terminate in interlocking buckle members 150, 152.

A coil zipper 88 preferably fabricated of nylon, is provided for closure of the pouch pocket access opening 85 and pouch 120. As shown in FIG. 2, the coil zipper 88 is secured between longitudinally extending pouch pocket edge sections **82*a*, 86*a* and corresponding carrying bag pocket edge sections 44*a*, 46*a* by the stitching 96**.

From the foregoing it will be appreciated that the present invention provides a convertible garment 10 particularly useful for providing versatile leisure and ahtletic apparel which achieves the objects stated heretofore.

In particular, the present invention provides a collapsible garment 10 of uncomplicated construction including a topologically continuous arrangement of outerwear 20 and pockets 40, 80 which may be readily converted into a large capacity carrying bag 100 or pouch 120. In a departure from the teachings of the prior art, there is provided a pocket 40 dimensioned to provide a carrying bag 100 which encloses an interior space having a volume capacity substantially larger than that required for receiving the outer garment 20, this providing a convertible garment 10 having utility as both a pocket 40 and carrying bag 100. When the collapsible garment 10 is arranged in the form outerwear 20, the carrying bag pocket 40, by reason of its light weight construction and arrangement in the interior of the outerwear 20, conforms to the contour of the outer garment 20 to provide a comfort fit and stylish outer garment 20. Further advantage is provided by provision of flexible carrying straps 10 which depend from the interior surfaces of longitudinally extending pocket panels 42, 44 in a compact arrangement (see FIG. 2).

The collapsible garment 10 also provides decided manufacturing advantages by reason of its uncomplex design. By way of example, the collapsible garment 10 does not employ a garment liner as provided in prior art arrangements to form the carrying bag and to overly abrasive fastening elements. It will be appreciated that this effects costs savings in materials and labor. Further the arrangement of pockets 40, 80 of the collapsible garment 10 may be provided in standardized sizes to accommodate a range of outerwear styles, effecting further cost savings.

Numerous modifications are possible in light of the above disclosure. For example, although pockets 40, 80 are disclosed as being secured to an interior surface 23 of outerwear 20, the pocket arrangement may be secured to an interior surface of the rear body portion 24 of the outerwear 20 or to the exterior of outerwear 20 if so desired. Similarly, the coil fastening zippers 65, 88 provided for closure of pockets 40, 80 and carrier bag and pouch 100, 120 may be replaced with an arrangement of buttons or other conventional fasteners. It is to be understood, therefore, that the above described embodiment of the invention is merely illustrative and that other embodiments may be devised by those skilled in the art without departing from the spirit or scope of the present invention as set forth in the appended claims.

I claim:

1. A convertible outerwear and carrying bag combination comprising:

an outer garment having interior and exterior surfaces, a carrying bag pocket attached to the outer garment, and a garment opening defined in the exterior surface of the outer garment, the carrying bag pocket and the outer garment being disposed in topologically continuous relation such that the carrying bag pocket may be inverted through the garment opening and arranged to receive the outer garment, the carrying bag pocket when inverted through the garment opening providing a carrying bag enclosing a space substantially larger than that required for receiving the outer garment.

2. A convertible combination as set forth in claim 1 wherein the carrying bag pocket includes panel sections having interior and exterior surfaces and longitudinally extending edge sections, the longitudinally extending edge sections being secured to and defining the opening in the outer garment.

3. A convertible combination as set forth in claim 2 wherein the longitudinal edge sections extend substantially across the width of the outer garment.

4. A convertible combination as set forth in claim 1 wherein the carrying bag pocket is attached to the interior surface of the garment.

5. A convertible combination as set forth in claim 4 further comprising securing means for closure of the carrying bag pocket and the carrying bag, the securing means including a coil zipper attached to the longitudinal edges of the carrying bag pocket panels.

6. A convertible combination as set forth in claim 3 further comprising a handle means receivable within and attached to the interior surfaces of the carrying bag pocket when the carrying bag pocket is disposed within the outer garment, the handle means being disposed on the exterior surface of the carrying bag formed by inverting the carrying bag pocket through the garment opening.

7. A convertible combination as set forth in claim 6 wherein the handle means includes flexible strap members extending exteriorly of the longitudinally extending pocket edges.

8. A convertible combination as set forth in claim 7 further comprising a pouch pocket secured to the exterior surface of the carrying bag pocket, the pouch pocket having panel sections defining an access opening in the carrying bag pocket;

the outerwear, the carrying bag pocket and the pouch pocket being arranged in topologically continuous relation such that the pouch pocket may be inverted through the carrying bag access opening and the outerwear garment opening and arranged to receive the outerwear and carrying bag pocket, the pouch pocket providing a pouch by enclosing an interior chamber having a volume capacity for containing the outerwear and the carrying bag pocket in compact relation.

9. A convertible outerwear and carrying bag combination comprising:

an outer garment having interior and exterior surfaces;

a carrying bag pocket attached to the interior surface of said outer garment, the carrying bag pocket including panel sections defining a garment opening in the exterior surface of the outer garment, the panel sections having interior and exterior surfaces, the carrying bag pocket and the outer garment being disposed in topologically continuous relation such that the carrying bag pocket may be inverted through the garment opening and arranged to receive the outer garment, the carrying bag pocket when inverted through the garment opening providing a carrying bag by enclosing a volume substantially larger than that required for receiving the outer garment;

handle means receivable within and attached to the interior surfaces of the carrying bag pocket, the handle means being disposed on the exterior surface of the carrying bag formed by inverting the carrying bag pocket through the garment opening; and a pouch pocket secured to the exterior surface of the carrying bag pocket, the pouch pocket having panel sections defining an access opening in the carrying bag pocket;

the outerwear, the carrying bag pocket and the pouch pocket being arranged in topologically continuous relation such that the pouch pocket may be inverted through the carrying bag access opening and the outerwear garment opening and arranged to receive the outerwear and carrying bag pocket, the pouch pocket providing a pouch by enclosing an interior chamber having a volume capacity for containing the outerwear and the carrying bag pocket in compact relation.

10. A convertible combination as set forth in claim 9 wherein the carrying bag pocket panel sections include longitudinal edge sections extending substantially across the width of the outer garment, the edge sections defining the opening in the outer garment.

11. A convertible combination as set forth in claim 10 further comprising securing means for closure of the carrying bag pocket and the carrying bag, said securing means including a coil zipper attached to the longitudinal edges of carrying bag pocket.

12. A convertible combination as set forth in claim 9 wherein the panel pouch sections include longitudinal edge sections defining the pouch access opening.

13. A convertible combination as set forth in claim 12 further comprising a securing means for closure of the pouch pocket and the pouch, the securing means including a coil zipper attached to the longitudinal edges of the pouch pocket.

14. A convertible combination as set forth in claim 13 further comprising an elastic belt secured to the pouch, the belt including a buckle attachment.

15. A convertible combination as set forth in claim 14 wherein the outerwear garment, the bag and the pouch are fabricated of nylon.

16. A convertible combination as set forth in claim 15 wherein the flexible strap members are fabricated of cotton.

* * * * *